United States Patent [19]

Artzt et al.

[11] Patent Number: 4,760,716

[45] Date of Patent: Aug. 2, 1988

[54] METHOD AND CIRCULAR KNITTING MACHINE FOR PRODUCING KNIT GOODS WITH COMBED-IN FIBERS

[75] Inventors: Peter Artzt; Gerhard Egbers, both of Reutlingen; Helmut Grimm, Neckartailfingen; Klaus Kunde, Kohlberg; Adolf Seidel, Reutlingen; Helmut Hascher, Stuttgart; Wolfgang Kolb, Reutlingen; Erwin Schäberle, Gäufelden; Peter Wachsmuth, Leinfelden, all of Fed. Rep. of Germany

[73] Assignee: Sulzer Morat GmbH, Filderstadt, Fed. Rep. of Germany

[21] Appl. No.: 775,523

[22] Filed: Sep. 13, 1985

[30] Foreign Application Priority Data

Sep. 13, 1984 [DE] Fed. Rep. of Germany ..... 3433642

[51] Int. Cl.[4] ..... D04B 9/12

[52] U.S. Cl. ..... 66/9 B

[58] Field of Search ..... 66/9 B

[56] References Cited

U.S. PATENT DOCUMENTS

| | | | |
|---|---|---|---|
| 3,248,902 | 5/1966 | Radtke | 66/9 B |
| 3,447,343 | 6/1969 | Frishman et al. | 66/9 B |
| 3,563,058 | 2/1971 | Schmidt | 66/9 B |
| 3,896,636 | 7/1975 | Thore | 66/9 B |
| 3,959,993 | 6/1976 | Fegeat | 66/9 B |
| 3,973,414 | 8/1976 | Golladay et al. | 66/9 B |
| 4,007,607 | 2/1977 | Christiansen et al. | 66/9 B |
| 4,458,506 | 7/1984 | Artzt et al. | 66/9 B |

FOREIGN PATENT DOCUMENTS

| | | | |
|---|---|---|---|
| 117234 | 8/1984 | European Pat. Off. | 66/9 B |
| 1569644 | 6/1980 | United Kingdom | 66/9 B |
| 2085485 | 4/1982 | United Kingdom | 66/9 B |

*Primary Examiner*—Ronald Feldbaum

[57] ABSTRACT

The invention concerns a process and a circular knitting machine for the production of knit goods with combed-in fibers, in which an amount of fibers synchronous with the needle cylinder rotatory speed is fed to a teasing cylinder rotating at high speed, transferred by the latter to the comb-in zone, and taken from the needles in the comb-in zone without contacting the teasing cylinder. To prevent the development of areas overfilled with fibers or short of fibers in the finished knit goods on account of the contact-less fiber feed, during or before abrupt reductions or increases in the rotatory speed of the needle cylinder, at least temporarily smaller or larger amounts of fibers are fed to the comb-in zone than corresponds to the synchronous amount of fibers.

10 Claims, 5 Drawing Sheets

METHOD AND CIRCULAR KNITTING MACHINE FOR PRODUCING KNIT GOODS WITH COMBED-IN FIBERS

BACKGROUND OF THE INVENTION

The invention relates to a method of producing, on a circular knitting machine having a rotatable needle cylinder, knit fabrics having combed-in fibers and a preselected fiber density, the method comprising the steps of delivering an amount of fibers synchronous with the needle cylinder rotary speed to a teasing cylinder rotating at high speed, yielding fibers from said teasing cylinder to a comb-in zone and transfering fibers in the comb-in zone to the needles without the needles contacting the teasing cylinder. The invention further relates to a knitting machine on which this method can be carried out.

In methods and circular knitting machines of this kind (U.S. Pat. Nos. 4,458,506 and 4,546,622 the fibers, in contrast to conventional methods and circular knitting machines U.S. Pat. No. 3,709,002 are combed contactlessly into the needle hooks, the term "contactlessly" meaning that the needle hooks do not pass through teasing hooks. The transfer of the fibers to the comb-in zone is performed as in circular knitting machines with conventional combs under conditions synchronous with the rotation of the needle cylinder. The term, "synchronous conditions", is to be understood to mean that, at any constant rotatory speed of the needle cylinder, the fibers are always delivered to the comb-in zone at a preselected, constant amount of fibers per unit time, so as to produce goods having a preselected, constant fiber density. On the other hand, the amount of fiber fed to the comb-in zone changes synchronously in the case of changes in the needle cylinder rotatory speed, in order that, in the event of reductions or increases in the needle cylinder rotatory speed, correspondingly less or more fibers will be delivered to the comb-in zone, thereby assuring that the preselected fiber density will be achieved at any rotatory speed of the needle cylinder, i.e., especially during the execution of start and stop cycles. If the feed of fiber to the teasing cylinder by means of feed rolls, for example, "synchronous conditions" means that the feed rolls and the needle cylinder are driven from a single, main drive through gears, belts, rollers or the like, so that the ratio of their rotatory speeds is the same at all rotatory speeds of the needle cylinder, and that, independently thereof, the teasing cylinder is driven always at the same high rotatory speed at all needle cylinder speeds.

Experiments on such circular knitting machines with contactless fiber feed have surprisingly shown that, during those phases in which the needle cylinder is subjected to abrupt changes of rotatory speed, such as is the case especially during the start and stop cycles and during "tip" operation, undesirable deviations from the preselected fiber density can result, which lead to thick and thin areas in the finished knit goods.

"Thick and thin areas" in this connection refers to those points in the finished goods at which the fiber density is lower or higher than the preselected fiber density. The length of the thick and thin areas appears to be dependent upon a number of factors, such as the length of time for which the needle cylinder is stopped, the duration of the braking or accelerating cycles of the needle cylinder until it reaches a full stop or the production speed, the fiber length, or the titer of the fibers.

The invention is addressed to the problem of improving the method and the circular knitting machine of the kind defined such that thick and thin areas will be largely avoided. In particular, those thick and thin areas are to be avoided such as can develop upon the abrupt braking of the needle cylinder to a stop, e.g., due to thread breakage or the like, or upon the acceleration of the needle cylinder from a full stop until it reaches the production speed.

The method of this invention is characterized by substantially maintaining constant the preselected fiber density also when abrupt changes of the rotary speed of the needle cylinder occur by at least momentarily feeding amounts of fibers which differ from the synchronous amount of fibers to the comb-in zone. A circular knitting machine for the production of knit goods with combed-in fibers comprises according to this invention a rotatable needle bearing needle cylinder, a card which has a means for feeding the fibers, a comb-in zone through which the needles pass for the purpose of contactless fiber pickup, and a teasing cylinder rotating at high speed which takes the fibers from the feed means and gives them to the comb-in zone, and a drive means for the synchronous driving of the needle cylinder and feed means. The card has a controller which becomes active upon abrupt changes in the rotary speed of the needle cylinder for the synchronous changing of the amount of fibers yielded to the comb-in zone.

The invention brings with it the surprising advantage that a great number of thick and thin areas can be prevented by the simple measure of feeding fewer fibers upon the abrupt braking of the needle cylinder, but more fibers upon the acceleration of the needle cylinder from a full stop, than would correspond to the synchronous amounts of fibers.

Additional advantageous features of the invention will be found in the subordinate claims.

The invention will now be further explained in conjunction with the appended drawing of a preferred embodiment.

SUMMARY DESCRIPTION OF THE DRAWINGS

FIG. 1 is a diagrammatic longitudinal cross section taken through a circular knitting machine according to the invention, FIGS. 2 and 3 are longitudinal sections taken through the area surrounding the comb-in zone of the knitting machine of FIG. 1, on an enlarged scale and in two different positions, FIG. 4 is a perspective diagrammatic representation on a larger scale of the area surrounding the comb-in zone of the circular knitting machine of FIG. 1, and FIG. 5 is the block circuit diagram of a control system for the circular knitting machine of FIG. 1.

DESCRIPTION OF THE PREFERRED EMBODIMENT

Figure 1:
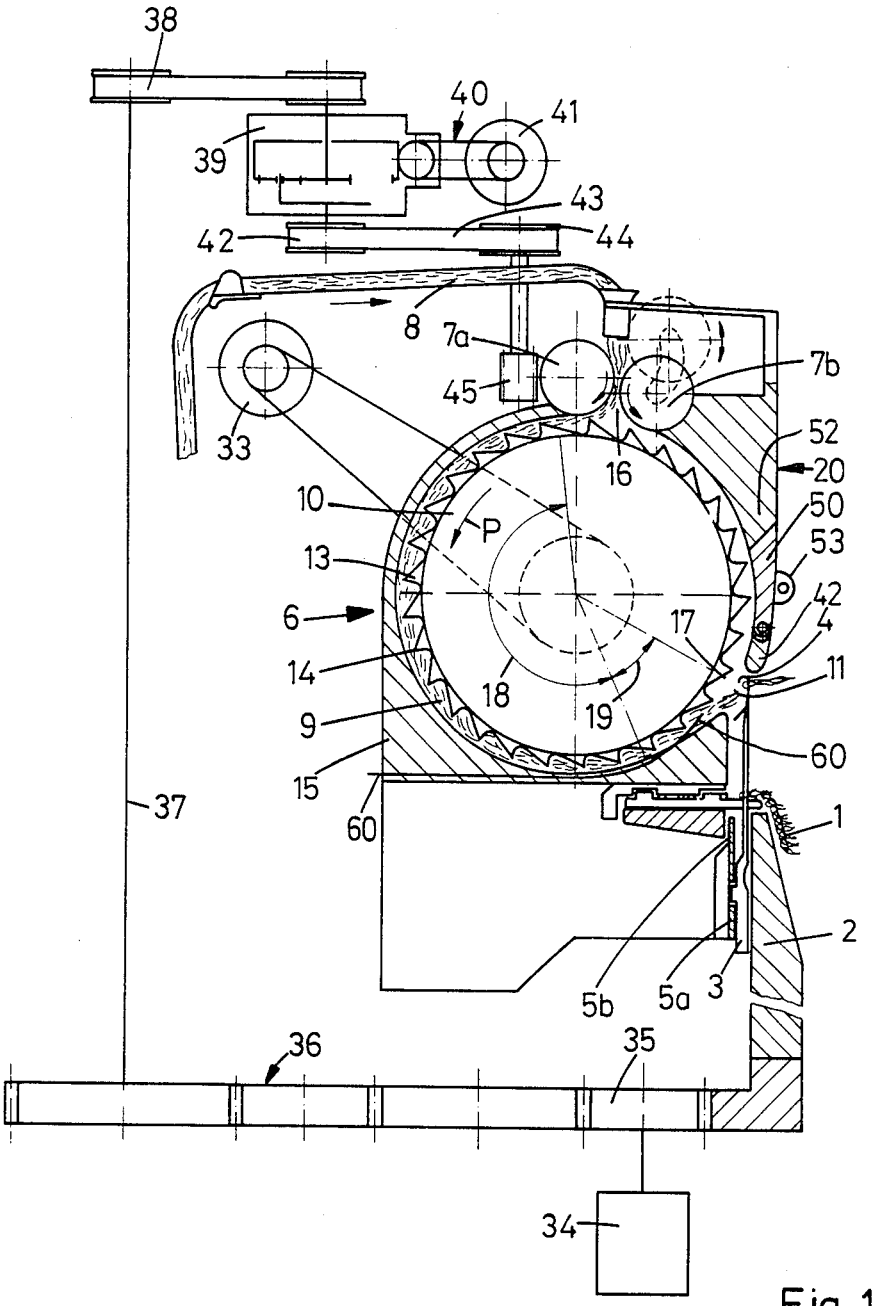

In FIG. 1, and in U.S. Pat. Nos. 4,458,506 and 4,546,622, a circular knitting machine for the production of high-pile knit goods 1 contains a rotatable needle cylinder 2 in which vertically displaceable knitting needles 3 with hooks 4 are mounted, which are moved up and down in the area of at least one knitting system by means of stationary cam parts 5*a* and 5*b*, for the purpose of producing a base knit fabric from the yarns that are not shown. The fibers are loosened up and combed into the knit fabric by means of at least one comb or carding unit 6, which consists, for example, of a feed system consisting, for example, of two feed cylinders *7a* and *7b* for feeding a condensed sliver or fiber band 8, a teasing or separating cylinder 10 intended to break up the fiber band 8 into individual fibers 9, and a comb-in zone 11 through which the knitting needles 3 and their hooks 4 pass in order to pick up the fibers 9.

The teasing cylinder 10, which can rotate in the direction of an arrow P, is covered on its circumference with a clothing 13 bearing outwardly projecting hooks 14. The teasing cylinder 10 is driven at a substantially greater circumferential speed than the feed cylinders 7, and therefore pulls the fiber band 8 apart in single fibers 9.

To prevent the fibers picked up by the teasing hooks 14 from being flung back out of the hooks, despite the great effective centrifugal forces acting on them due to the high speed of the loosening cylinder 10, the comb 6 has a shroud 15, which is preferably a part of a fully enclosed casing 20 surrounding the teasing cylinder 10 and the comb-in zone 11, and is situated opposite the outer circumference of the teasing cylinder 10, and contains an entry 16 for the fiber band 8 fed by the feed cylinders 7 and an exit opening 17 through which the fibers 9 can be fed into the comb-in zone 11. The shroud 15 then defines the outside of a teasing and accelerating section 18 beginning directly at the entry opening 16 and indicated by an arrow, within which the shroud 15 is at a small, but otherwise constant distance of, for example, less than one millimeter, from the tops of the teasing hooks 14 of the teasing cylinder 10, so that the fibers cannot come off the teasing hooks 14. The teasing and accelerating section 18 is then followed, in the direction of rotation of the teasing cylinder, by a teasing or detachment section or zone 19 indicated by an arrow, which ends at the exit opening 17 and is at a distance from the tips of the teasing hooks 14 which gradually increases in the direction of rotation to a value of, for example, several millimeters. Therefore, the fibers 9 can be loosened in this section 19 by the centrifugal force, entrained tangentially in the air stream produced by rotation of the teasing cylinder, and combed into the knitting needles lifted by the cam parts 5 in the comb-in zone, without coming in contact with the teasing hooks 14.

With the teasing cylinder 10 there is associated a drive independent of the conventional needle cylinder drive, in the form of a motor 33 which drives the teasing cylinder 10 at a speed that is constant at all knitting machine speeds, or can be adapted to a certain extent to the momentary knitting machine speeds and/or the properties of the fibers involved. The motor 33 can be a reversible-pole motor having at least two rotatory speeds.

In known circular knitting machines of this kind (U.S. Pat. Nos. 4,458,506 and 4,546,622), the feed cylinders 7 are driven synchronously with the needle cylinder rotatory speed. According to the invention, however, a drive 34 is provided—a motor for example—which is connected on the one hand by a gear 35 to the crown gear of the needle cylinder 2, and on the other hand by additional gears 36, a shaft 37 and a belt drive 38 to one input of a differential gearing 39. Another input of this differential gearing 39 is connected by another belt drive 40 to the output shaft of a servo motor 41. On the output shaft of the differential gearing 39 there is fastened a belt pulley 42 which is connected by a belt 43 to another belt pulley 44 on whose shaft there is fastened a worm 45. This worm is engaged in the usual manner with a worm gear which is mounted on one of the shafts of the feed cylinder 7 and serves to drive the latter. On the basis of the drive just described, it is possible to drive the feed cylinders 7 either synchronously with the needle cylinder if the servomotor 41 is stopped, or, if motor 34 is stopped, synchronously with the rotatory speed of the servomotor 41, or, if both motors 34 and 41 are running, the feed cylinders can be driven at a resultant speed. If the servo motor 41 is a reversible motor, the feed cylinders can be driven either at a greater or at a lower rotatory speed than the momentary rotatory speed that can be produced through the gears 35, 36 and 38 and is synchronous with the needle cylinder speed, since the differential gearing will add or subtract the two input speeds depending on the direction of rotation of the servo motor 41. The differential gearing thus constitutes a means for the interruption and restoration of synchronism between the feed means and the needle cylinder.

Figure 2:
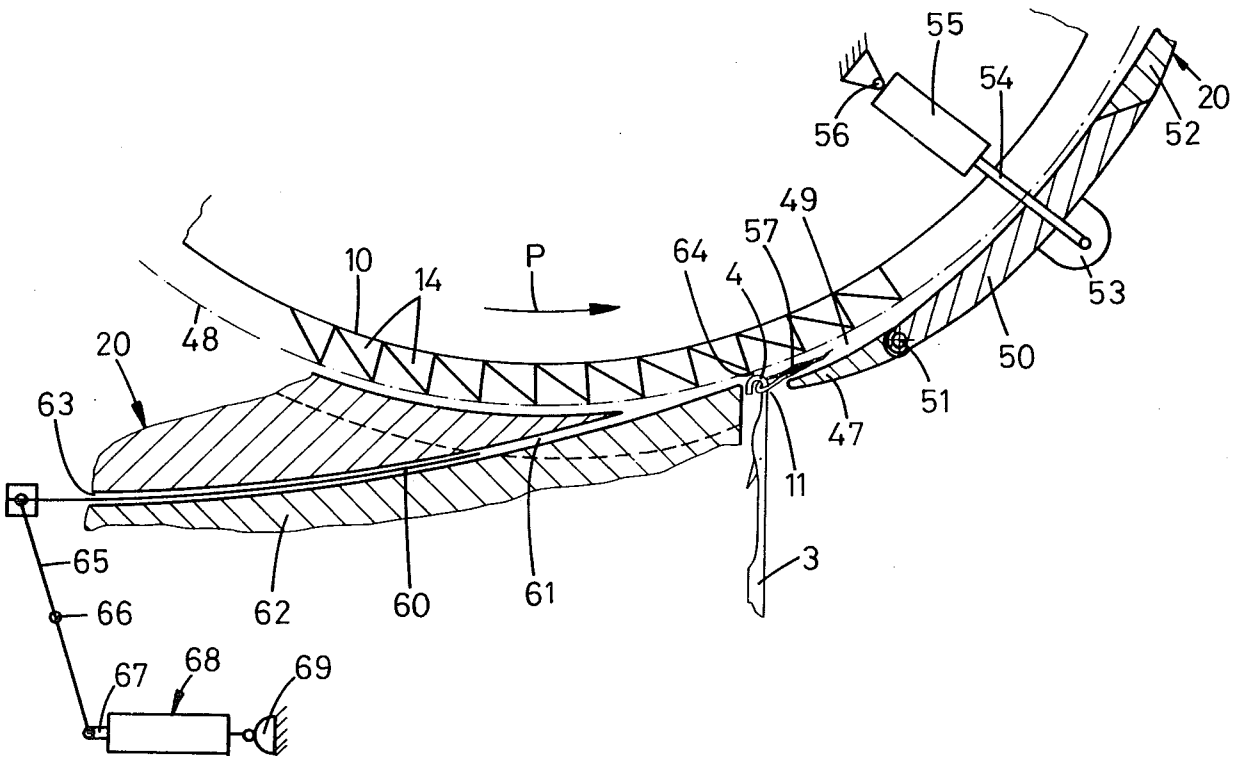
Figure 3:
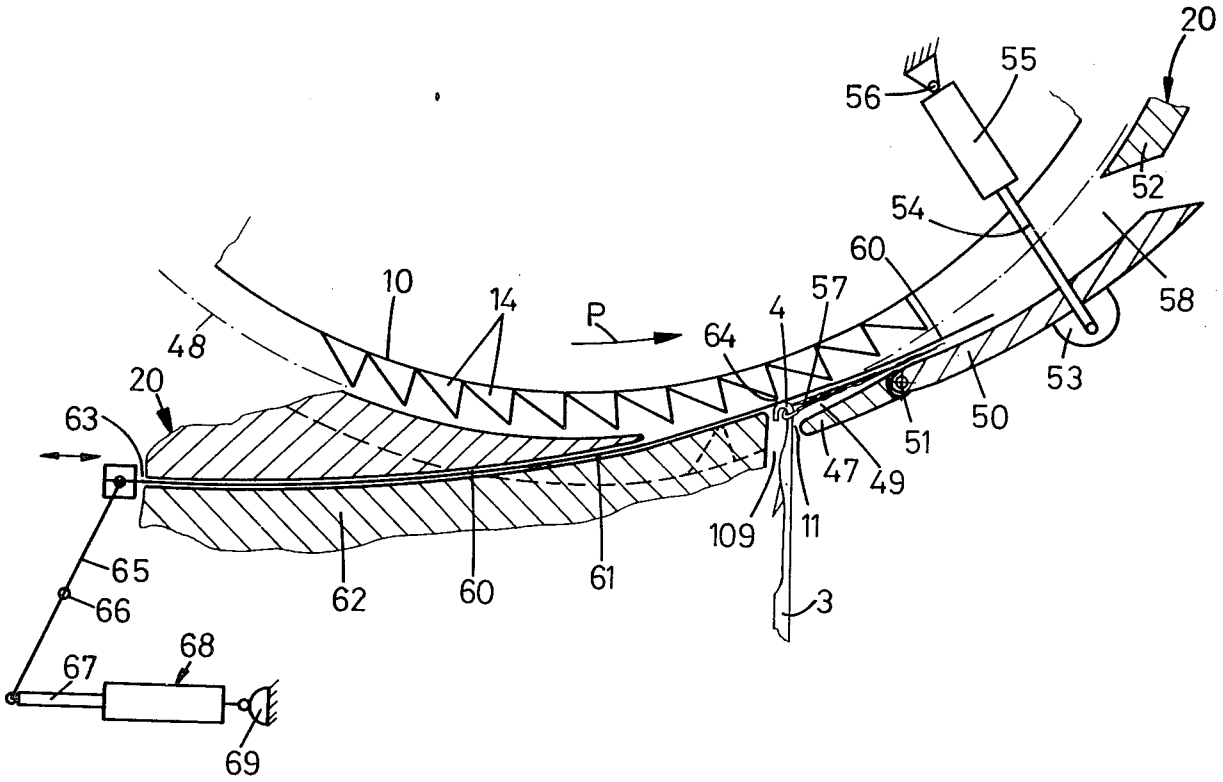

According to FIGS. 2 and 3, the casing 20 has in the area adjacent the needle backs a fixed fiber guiding plate 47 whose end at the comb-in zone 11 is of streamlined shape. The fiber guiding plate 47 is disposed such that, in back of the needles 3, and between it and an imaginary cylindrical surface 47 in which the tips of the teasing hooks 14 move, a wedge-shaped gap 49 is formed (U.S. Pat. No. 4,546,002). Furthermore, in back of the fiber guiding plate 47, in the direction of rotation of the teasing cylinder 10, there is provided an ejection flap 50 which is articulated on a pivot pin 51 on the fiber guiding plate 47 and is preferably a part of the latter. The other end of the ejection flap 50 adjoins, along a sloping junction, a fixed casing part 52, the components 47, 50 and 52 extending preferably at least over the width of the teasing cylinder. The ejection flap 50 has a lug 53 which is joined to an actuator 55 which consists, for example, of a solenoid coil with a plunger 54 which can be extended and retracted and is linked to the lug 53. This actuator 55 is disposed laterally beside the teasing cylinder 10 and is pivoted on a pivot pin 56 on a stationary machine part. In the disengaged position, e.g., when the plunger 54 is retracted, the fiber guiding plate 47 and the closed ejection flap 50 form a substantially continuous fiber guiding surface (FIG. 2) which prevents fibers from being thrown off the teasing hooks 14 and produces a combing out and orientation of the fiber tufts which have already been laid into the needles but are still in the comb-in zone 11. If, however, the plunger 54 is pushed out of the solenoid 55 by means of an electrical signal, the rear end of the ejection flap 50 is rocked in the manner shown in FIG. 3 radially away from the teasing cylinder 10 to the working position. This results in the formation of an ejection opening 58 virtually tangential to the circumference of the teasing cylinder 10, and any fibers that are still on the teasing hooks 14 are released by the centrifugal forces and then are, for example, aspirated by a central aspirating system.

Figure 4:
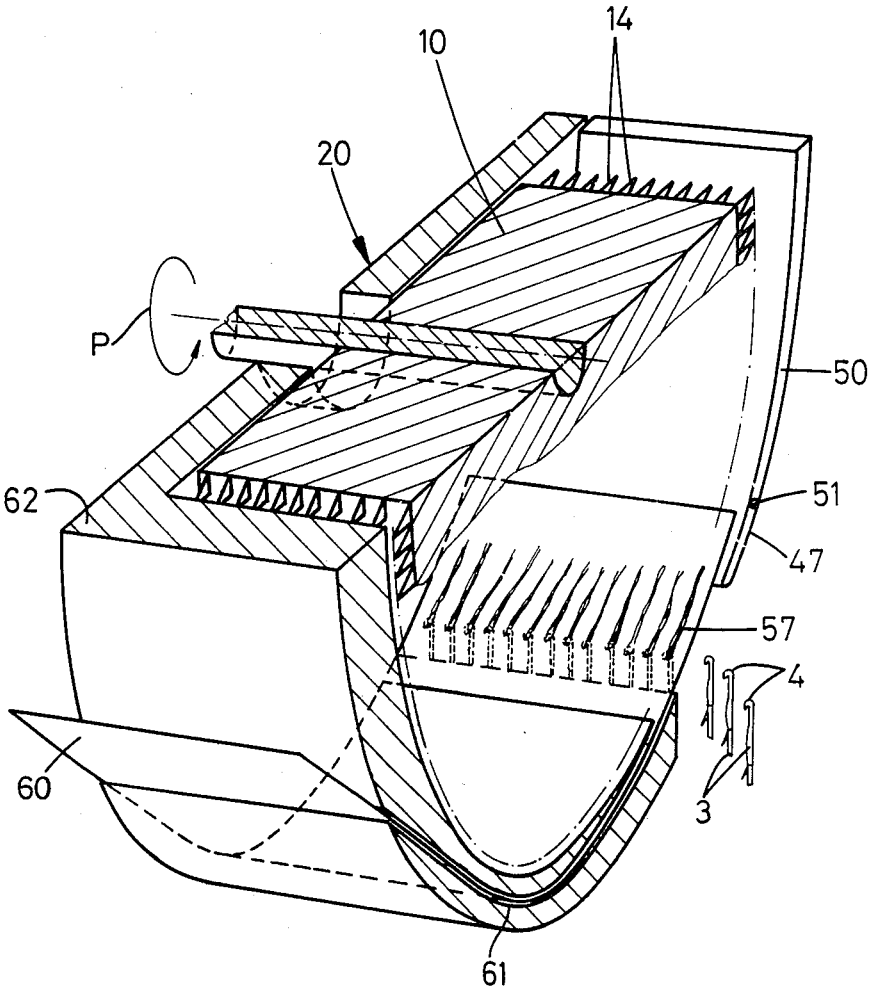

Preferably ahead of the needles 3, in the direction of rotation of the teasing cylinder 10, there is disposed in accordance with the invention a blocking means 60 for blocking the needle hooks 4 that are in the comb-in zone 11. This blocking means 60 serves to block off the open needle hooks 4 if necessary, so that they will not pick up any more fibers. In accordance with FIGS. 1 to 3, the blocking means 60 is a thin, e.g., 0.15 mm thick, plate extending preferably at least over the width of the teasing cylinder 10 and guided displaceably in a slotted guide 61 which is provided in a wall portion 62 (FIGS. 2 to 4) surrounding the teasing cylinder. The slotted guide 61 runs from one exit end 63 of the wall portion 62 situated ahead of the comb-in zone in the teasing cylinder's direction of rotation, substantially tangentially to the teasing cylinder 10, and toward a gap 64, which is defined on the one hand by the upper ends of the needle hooks 4 raised to receive fibers, and on the other hand by the cylindrical surface 48, and whose width is slightly greater than the thickness of the blocking means 60. The end of the blocking means 60 protruding from the exit end 63 is linked to one end of a rocking arm 65 which is pivoted in its central portion at 66 and is linked at its other end to an actuator 68 which consists, for example, of a solenoid having a plunger 67 linked to the rocking arm 65, and is pivotally mounted on a fixed part 69 of the machine. By feeding an operating signal to the actuator 68, the blocking means 60 can therefore be moved either to the disengaged position shown in FIG. 2 in which it releases the gap 64 and is withdrawn far into the slotted guides 61, or it can be moved to its working position as shown in FIG. 3. In this working position, the end of the blocking means 60 associated with the needles extends both through the slot 64 and also through the wedge-shaped gap 49 that follows in the direction of rotation of the teasing cylinder. Due to the fact that the blocking means 60 extends through the slot 64, the open needle hooks 4 are blocked such that, ahead of the comb-in zone 11, fibers released from the card teasing hooks 14 are not combed into the needle hooks 4. Since the blocking plate extends into the wedge-shaped gap 49, however, the fiber tufts 57 combed into the needle hooks are protected against the teasing hooks 14 regardless of the fiber length selected in the individual case, and therefore they cannot be attacked by the teasing hooks and pulled out of the needle hooks. The blocking means 60 is thus a component of a protective means for preserving the fiber tufts 57 combed into the needles 3 situated in the comb-in zone. At the same time the section covering the needle hooks and the section covering the fiber tufts 57, of the blocking means 60, could also be separated from one another and connected to different actuating means. Also, the rocking arm 65 is shown much shorter than it would be, and actually it is about as long as is necessary to achieve the desired length of movement of the blocking element 60.

Figure 5:
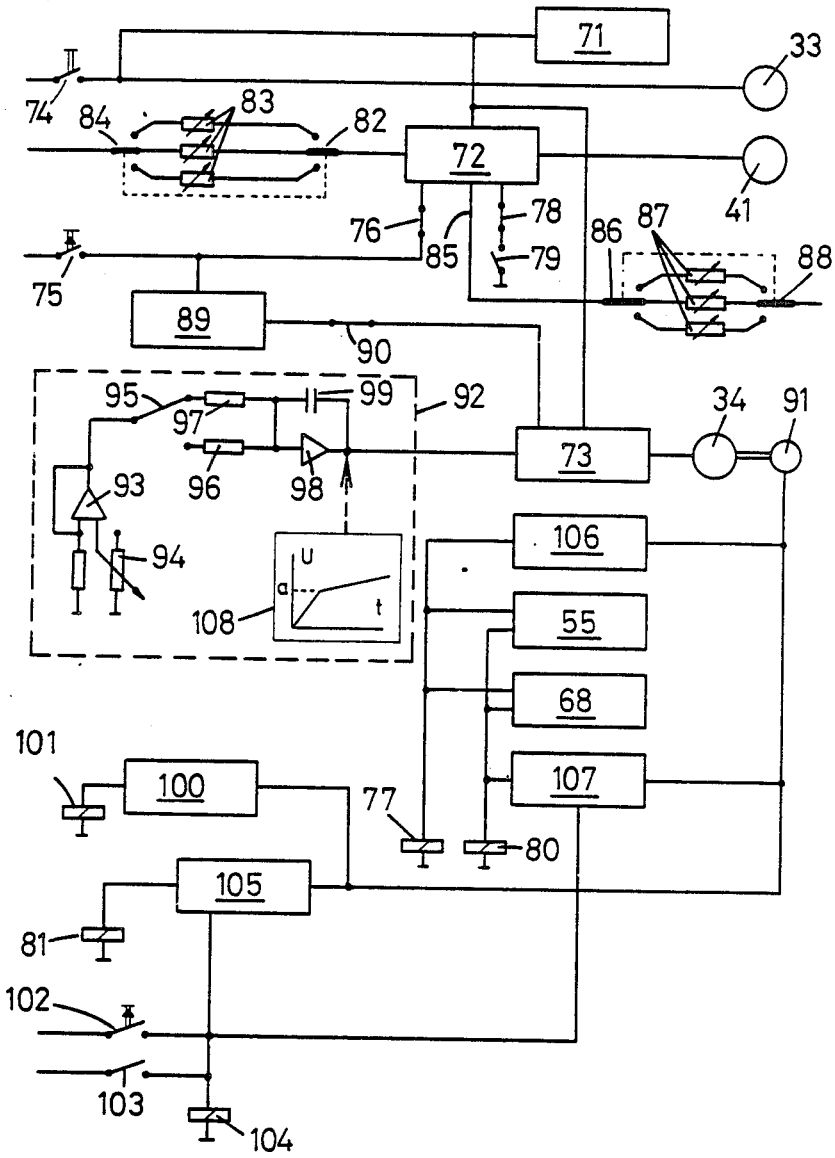

FIG. 5 shows a control apparatus for the circular knitting machine described in conjunction with FIGS. 1 to 4. It contains a power supply 71 which provides current to all electronic and electromagnetic components, especially a controller 72 for the servo motor 41 and a controller 73 for the drive 34 of the circular knitting machine, and is also connected to a main switch 74. The controller 72 for the servo motor has an input connected to the power supply 71 and an output connected to the servo motor. Another input is connected to a starter switch 75, a switch 76 being inserted into the line running to the latter, which can be brought by an actuator 77 from its normal, closed position to an open position. Another input of the controller 72 is connected to two switches 78 and 79 which are in series. Switch 78 can be brought by an actuator 80 from its normal, closed position to an open position, while switch 79 can be brought by an actuator 81 from its normal, open position to a closed position. An additional input of the controller 72 is connected to the moving contact of a switch 82 which can be turned to any of three solid contacts which are connected each with a potentiometer 83. The other terminals of this potentiometer 83 are connected to three fixed contacts of an additional switch 84, which also has a contact that can be moved to one of the three fixed contacts. The switches 82 and 84 and the potentiometer 83 form a preselection circuit and serve to provide the controller 72 with, for example, three individually selectable rotatory speeds for the rotation of the servo motor 41 in the forward direction. Another input of the controller 72 is finally connected by a line 85 to the moving contact 86 of a switch whose three fixed contacts are connected by potentiometer 87 to three fixed contacts of a switch 88 such that, with the switches 86 and 88 and the potentiometers 87, three individually presettable rotatory speeds, for example, can be selected for the servo motor 41 when it runs in the reverse direction.

The starter switch 75 is connected by an adjustable timer 89 to the fixed contact of a switch 90. The moving contact of this switch 90 is connected to the controller 73 for the motor 34 of the needle cylinder. This motor 34 has an indicator in the form of a tachometer generator 91 which, in the usual manner, consists of a dynamo which provides at its output a voltage which is proportional to the rotatory speed of the motor 34. The output of a reference standard 92 is connected to an additional input of the controller 73. The reference standard 92 contains an ordinary amplifier 93 to whose one input a potentiometer 94 is connected and whose output is connected to the moving contact of a switch 95 whose two fixed contacts are connected each through a resistance 96–97 to the input of an additional amplifier 98. The output of the tachometer generator 91 is connected to the input of a comparator 100 to whose output is connected an actuator 101 which serves to shift the moving contact of switch 95 from the one to the other fixed contact of this switch.

The controller furthermore contains a manually operated stop switch 102 and, if necessary, at least one automatically operating stop switch 103, for example in the form of a shutoff commonly used in circular knitting machines, which is tripped in the event of thread breakage, needle breakage or the like. The two switches 102 and 103 are connected to an actuator 104 which serves to shift the normally closed switch 90 to an open position. The actuator 81 is connected to the output of a comparator 105 whose input is connected to the output of the tachometer generator 91. Otherwise, the free terminals of switches 75, 84, 88, and 102 and 103 of the potentiometer 94 are connected to the power supply or to some other appropriate source of current or voltage.

Lastly, the controller of FIG. 5 has two additional comparators 106 and 107. The output of comparator 106 is connected on the one hand to one input of each of the actuators 55 and 68 and on the other hand to the actuator 77 of switch 76, while the comparator 107 is connected on the one hand with an additional input of each of actuators 55 and 68 and on the other hand to the actuator 80 of switch 78. The inputs of the comparators 106 and 107 are connected to the output of the tachometer generator 91.

The switches 76, 78, 79, 90 and 95 and their associated actuators 77, 80, 81, 101 and 104 can consist of purely electronic components, but also they can be electromechanical components, e.g., reed contacts operated by relays.

In the control system described, the following adjustments are possible:

Depending on the type of fiber to be used, which can vary in regard to fiber length, titer or the like, first the ganged pairs of switches 82–84 and 86–88 can be set such that the servo motor 41, whether turning forward or backward, will run at a rotatory speed determined according to the type of fiber. The rotatory speeds required in each case are to be determined in preliminary tests with the fibers to be used, and if necessary can be recorded in tables. Experiments have shown that, in most practical cases, three different rotatory speeds forward and three in reverse will suffice, and that these speeds can be associated with fiber lengths up to 25 mm, between 25 and 40 mm, and 40 to 80 mm of length. This gives the advantage that the potentiometers 83 and 87 can be set one time, and, when the type of fiber changes, only switch pairs 82–84 and 86–88 will need to be changed. Furthermore, the timer 89 can be adjusted to the time desired in the particular case. The timer 89 determines how long a time the servo motor 41 is to be energized before turning on the motor 34 of the knitting machine. Here, again, the adjustment can be determined on the basis of the type of fiber and recorded in tables. It would also be possible to provide several fixed timers, each associated with one type of fiber. It is desirable, however, to adjust the timer to a sufficiently long period of time to permit a sufficiently long preliminary feed by the servo motor 41 for all of the types of fibers that are involved. An additional adjustment is offered by the potentiometer 94 which is associated with the reference standard 92. The reference standard 92 establishes through the controller 73 the accelerations with which the speed of the needle cylinder is to be increased during start-up, and on the other hand it establishes the maximum rotatory speed, i.e., the production speed which the needle cylinder is to reach. The production speed can be adjusted with the potentiometer 94. Lastly, it is possible to set the rotatory speed of the motor 33 driving the teasing cylinder 10, through an additional potentiometer not shown, or through a switch.

The control system described operates as follows:

By operating the main switch 74, first the motor 33 driving the teasing cylinder 10 and the power supply are turned on to supply power to the control system. By means of an interlock, which is not shown, provision can be made such that operation of the starter switch 75 will not be possible until the teasing cylinder has reached its nominal rotatory speed. The blocking means 60 and the ejection flap 50 are during this time in the working position represented in FIG. 3, while the needle cylinder 2 is stopped and the different switches assume the positions seen in FIG. 5. The result is that, in the area of the entrance opening 16, the teasing cylinder 10 teases out the part of the condensed sliver 8 that extends into the range of action of the teasing hooks 14. The fibers pulled out of the sliver in this manner are accelerated out of the teasing hooks 14 in the area of the releasing section 19, but, on account of the extended blocking means 60, are unable to enter into the needle hooks 4. Consequently, these fibers are transported on over the needlehooks and then ejected through the open ejection flap 50. At the same time, the blocking means 60 prevents fiber tufts 57, which have already been laid into the needle hooks in a preceding knitting action, from being pulled out of the needle hooks by the suction of the teasing cylinder 10 or by the interference of the teasing hooks. The fiber tufts 57 already laid in the needles that are in the comb-in zone therefore are retained, so that thick and thin areas are prevented when the needle cylinder starts up.

After the teasing cylinder 10 has reached its nominal speed, the starter switch 75 is closed, thereby delivering power through the closed switch 76 and the controller 72 to the servo motor 41 to make the latter run in the forward direction at a speed depending on the position of the switch pair 82–84 and the potentiometer 83. As a result, the feed rolls 7 are set in rotation and the portion of the fiber sliver partially torn apart by the teasing cylinder 10 is replaced at the entry 16. Thus, a higher rate of feed of fibers than the synchronous rate is fed to the comb-in zone 11, because in conventional high-pile knitting machines the feed cylinders are at rest as long as the needle cylinder is at rest. This process, which is known as forefeeding the fibers and is intended for the prevention of thin areas caused by start-up, likewise takes place when the needle cylinder is stopped, and lasts until the timer 89 emits a signal. When this signal appears, the sliver or sheet of fibers situated on the teasing cylinder 10 is again built up to the extent that is necessary for the knitting procedure that follows.

The signal from the timer 89 runs through the switch 90 and the controller 73 to start the motor 34 driving the needle cylinder, preferably with an initial, comparatively great start-up acceleration established by the reference standard 92. This start-up acceleration results when the moving contact of switch 95 is connected to the resistance 97 which, with the capacitor 99, forms an RC circuit and results in a voltage rise at the output of the amplifier 98 corresponding to the first section of the U/t curve represented in a block 108 of the reference standard 92. The needle cylinder thus begins to rotate, and the tachometer generator 91 delivers a voltage proportional to the momentary speed of the motor 34, which is fed to the comparators 106 and 100 which were activated in the start-up cycle. When this voltage attains a relatively low value detected by the comparator 106, the comparator 106 emits a signal which is delivered to the actuator 77 which then opens the switch 76 thus turning off the servo motor 41. At the same time the output signal from the comparator 106 is delivered to the actuators 55 and 68, thereby shifting the ejection flap 50 and the blocking means 60 to the disengaged position seen in FIG. 2. As a result of the shutting off of the servo motor 41, the feed cylinders 7 are then driven at a speed determined only by the motor 34, i.e., a speed synchronous with the needle cylinder speed. The displacement of the ejection flap 50 and of the blocking means 60, however, brings it about that the needle hooks 4 are now released and the ejection opening 58 is closed, so that all of the fibers fed by the teasing cylinder 10 are placed in the needles 3. The synchronous rotation of the feed cylinders 7 now assures that the necessary amount of fibers will be fed. The voltage at which the comparator 106 emits its signal is best selected such that, when the needle cylinder is started, the lowest possible number of needles will enter the comb-in zone before the blocking means 60 is withdrawn, so as to prevent failure of delivery of fibers to a plurality of adjacent needles. In practical use, the voltage of the tachometer generator 91 can be selected at such a low level that no more than one needle will pass through the comb-in zone without picking up fibers.

The rotatory speed of the needle cylinder now increases with the acceleration preset by the reference standard 92. It can happen that some thin areas will occur in the goods on start-up, which are apparently due to the fact that, if excessively great accelerations occur, the synchronous rotatory speed of the feed cylinders 7 is not sufficient. To prevent such thin areas a changeover to a lower acceleration rate will be made at a needle cylinder speed to be determined by experiment. This is accomplished as follows: when the voltage of the tachometer generator 91 reaches a certain level, corresponding for example to the voltage a in block 108, the comparator 100 will emit a signal and thus by means of actuator 101 will shift the moving contact of switch 95. Consequently, the needle cylinder will then be accelerated at a second, lower rate until it has reached its preset production speed and is maintained at this speed by the controller 73. The lower speed is established in this case by the RC circuit formed by the resistor 96 and the capacitor 99.

If the knitting machine is to be shut off, either the stop switch 102 or the stop switch 103 is operated automatically. When this happens, the comparators 105 and 107 which were inactive during the start cycle are activated and at the same time the two comparators 106 and 100 which were active during the start cycle are rendered inactive. Furthermore, a signal is delivered to the actuator 104 causing it to open the switch 90, thus shutting off the motor 34 and at the same time actuating a magnetic brake to stop the needle cylinder.

The needle cylinder is then braked according to the amount of braking power applied, while the teasing cylinder 10 continues to run at an unchanged speed so that fibers are fed into all needles running through the comb-in zone until the needle cylinder comes to a full stop. Since the feed cylinders 7 are also braked during the stop cycle, the wire hooks 14 in the teasing cylinder 10 now tear a higher percentage of fibers from the fiber sliver projecting into the entry opening 16 than is necessary for the attainment of a uniform knit fabric. The thickened areas thus caused are avoided in accordance with the invention in that, upon the attainment of a preselected needle cylinder speed, the feed cylinders are rotated more slowly than the synchronous speed in order thereby to compensate the oversupply of fibers produced by the teasing cylinder. To this end, the comparator 105 is set to a preselected voltage, so that, upon the attainment of this voltage at the output of the tachometer generator 91, it will emit a signal which will operate the actuator 81 to close switch 79 and thus turn on the servo motor 41, through line 85 and the controller 72, in the reverse direction at a speed predetermined by the setting of the switch pairs 86–88 and the potentiometer 87. Thus the rate of fiber feed in the area of the comb-in zone 11 is reduced to such a level that thick areas in the fabric caused by the shutoff cycle are prevented. The rotatory speed at which the servo motor 41 is to be turned on must be determined by experiment. It can also happen that the servo motor must be turned on when the switches 102 and 103 are actuated, in which case the comparator 105 is to be set to a value just below the production speed or it is to be turned on directly by the switches 102 and 103.

To avoid thick areas from forming in the start cycle, the comparator 107 puts out a signal shortly before the needle cylinder stops; this signal is delivered on the one hand to the actuators 55 and 68 and on the other hand it turns off the servo motor through the actuator 80 and the switch 78 which it opens, so that, when the needle cylinder comes to a stop, the feed cylinders will stop also. The feeding of the output signal to the actuators 55 and 68 has the result of shifting the ejection flap 50 and the blocking means 60 back to their working position shown in FIG. 3, and therefore fibers which might be fed by the still rotating teasing cylinder 10 while the needle cylinder is stopped are not introduced in the needles 3, which are also stopped, but are removed through the ejection opening 58. Thus no more fibers are introduced even into those needles 3 which enter the comb-in zone just before the needle cylinder stops than corresponds to the desired fiber density. At the same time the output voltage of the tachometer generator 91 at which the comparator 107 emits its signal can be selected so as to be so low that only one more needle enters the comb-in zone after the blocking means has been moved forward. Furthermore, provision is made through the output signal of the comparator 107 so that all switches will then reassume the positions shown in FIG. 5.

The invention is not limited to the described embodiment, which can be modified in many ways. For example, it is possible to provide, instead of the blocking means 60, a covering flap suspended pivotally from the side walls of the shroud 15 and bearing at its end adjacent the needles 3 a plate which, when the covering flap turns, is introduced into a gap 109 (FIG. 3) between the shroud 15 and the front sides of the needles for the purpose of blocking their open hooks 4. This covering flap could also be controlled by a solenoid actuator. Instead of the fiber guide plate 47 containing the pivoted ejection valve 50, a fiber guide plate consisting of one piece and displaceable radially and, if desired, also circumferentially of the teasing cylinder 10, can be provided, or a pivoting fiber guide plate simultaneously forming the ejection flap. Such a fiber guide plate would have the advantage that, between the blocking means 60 in its active position and the end of the fiber plate associated with it, a sufficiently wide air aspirating gap could be formed, which would improve the air flow needed for the ejection of fibers. Furthermore, it is possible to provide, instead of the solenoids 55 and 56, other actuating means, e.g., hydraulic or pneumatic cylinder-and-piston systems. The ejection flap 50 can be disposed at a point between the entry opening 16 and the comb-in zone 11 in the direction of rotation of the teasing cylinder 10, and it can be connected, if desired, to an aspirator. In this manner shut-down thickenings can be prevented without requiring a blocking means for the needles, because all of the fibers entering the hooks 14 of the teasing cylinder 10 while the needle cylinder is stopped would be removed through the ejection opening before reaching the comb-in zone 11. Furthermore, the pivoting ejection flap 50 can be replaced by a sliding fiber guide plate, which offers advantages especially with regard to access to the parts of the card situated in back of the needles. The over-proportional braking of the feed cylinders 7 performed by means of the servo motor 41 could also be accomplished by means of a remote-controlled clutch (U.S. Pat. No. 3,709,002) by temporarily disengaging this clutch during the stop cycles or withdrawing it pulse-wise, in order thereby to interrupt at least momentarily the synchronous running of the feeding cylinders.

As seen in FIG. 5, it is possible with a small number of different, preset speeds of the servo motor 41 to prevent any and all thick and thin areas. There is also the possibility of replacing the preselecting means formed by the switch pairs 82–84 and 86–88 and potentiometers 83 and 87, with programmed preselecting means which constantly change the speeds of the servo motors on the basis of a predetermined schedule, e.g., a curve, individually attuned to the type of fiber used in the individual case. Accordingly, all of the rest of the circuit elements can be adapted individually to the type of fiber. Provision can furthermore be made for momentarily interrupting the synchronism between the feed means and the needle cylinder, not only in the starting and stopping cycles, but also in the event of any other abrupt speed changes. A momentary interruption of the synchronism can also be brought about by varying the distance between the feed means, e.g., the two feed cylinders 7, and the teasing cylinder 10, or by varying the rotatory speed of the teasing cylinder 10, because the synchronism between the feeding of fibers to the teasing cylinder and the fiber transfer to the comb-in zone resulting in the required fiber density is also affected by these factors.

Those parts of the guard means which serve for the prevention of the disengagement of fiber tufts already held on the needles can also be modified. It is mentioned only by way of example that, to this end, a) the teasing cylinder could be stopped upon every stop and restart and then started up again or at least it could be braked down, b) the conditions of flow in back of the comb-in zone could be arranged such that the fiber tufts cannot come in contact with the tips of the teasing hooks 14 when the needle cylinder is stopped, c) the distance between the teasing cylinder and the needles and/or the fiber guide plate could be increased while the needle cylinder is stopped, d) teasing hooks could be used which, when the needle cylinder is stopped, are retracted into the teasing cylinder 10, and e) compressed air or a vacuum could be produced by using teasing cylinders or fiber guide surfaces having screen-like surfaces, in order to keep the fiber tufts away from the card hooks 14.

The above-described controller can accordingly also be used in creep rate operation or for so-called tip operation, in which the needle cylinder is turned each time only briefly by a few needle spaces. In order even here to assure the preselected fiber density it can be necessary to further reduce the speed of the teasing cylinder or the feed rate of the fibers to the teasing cylinder or to sustain the synchronism in the operation of braking down.

Instead of the feed means represented, feed means can be provided which have at least one feed cylinder and a fiber guide plate associated with it (U.S. Pat. No. 3,968,662).

The invention has just been described in conjunction with the example of a single knitting system of a circular knitting machine. In circular knitting machines with a plurality of system, the described card 6 can be associated with each system. At the same time it is possible to drive a plurality of teasing cylinders with a single motor. Also, the term circular knitting machines is to include circular hosiery machines.

We claim:

1. A method of producing knit goods having combed-in fibers with a preselected fiber density on a circular knitting machine having a needle cylinder with needles and a carding unit with a feeding means for feeding a band of fibers, a separating cylinder for receiving said band, a detachment zone and a combing-in zone, comprising the steps of: rotating said needle cylinder at a variable rotary speed for moving said needles through said combining-in zone; rotating said separating cylinder independently of said needle cylinder rotary speed at such a high speed that said band is separated into single fibers and said fibers are substantially fully detached from said separating cylinder within said detachment zone and contactlessly inserted into said needles within said combining-in zone; delivering an amount of said band to said separating cylinder in correspondence with said preselected fiber density at a rate synchronous with the needle cylinder rotary speed; and substantially keeping constant said preselected fiber density when the needle cylinder rotary speed abruptly changes by reducing said synchronous rate when the rotary speed of the needle cylinder abruptly decreases, and by increasing said synchronous rate or limiting to a preselected value the acceleration of the needle cylinder, when the rotary speed thereof abruptly increases.

2. A method according to claim 1 wherein for the performance of a start cycle of the needle cylinder and the feeding means after a standstill thereof, the delivery of said band to said separating cylinder is initiated before the needle cylinder is again started for replacing a portion of the band of fibers partially torn apart by the separating cylinder during the standstill.

3. A method according to claim 2, wherein for the performance of a start cycle after a standstill of the needle cylinder, the feeding means and the separating drum, first said separating cylinder is accelerated for reaching its high speed and an amount of said band is fed to said separating cylinder for replacing a portion of the band of fibers partially torn apart by the separating cylinder before the standstill or during the acceleration thereof, and wherein after replacement of said portion the needle cylinder rotation is initiated.

4. A circular knitting machine for the production of knit goods having combed-in fibers with a preselected fiber density, comprising: a needle cylinder having needles and being rotatable at variable rotary speeds; a carding unit having feeding means for feeding a band of fibers, a combing-in zone through which the needles pass for the purpose of contactless fiber pickup, and a separating cylinder being rotatable at high speed independently receiving the band, separating said band into single fibers and delivering the fibers into the combing-in zone; means for controlling said feeding means such that an amount of said band is fed to said separating cylinder in correspondence with said preselected fiber density at a rate synchronous with the needle cylinder rotation; and means for substantially keeping constant said preselected fiber density when the needle cylinder abruptly changes its rotary speed, said means including a controller means becoming active upon abrupt changes in the needles cylinder rotational speed and means for reducing said synchronous rate when said needle cylinder rotary speed abruptly decreases, and means for increasing said synchronous rate or for limiting to a preselected value the acceleration of the needle cylinder, when the rotary speed thereof abruptly increases.

5. A circular knitting machine according to claim 4, wherein said controller means has means for changing the ratio between the needle cylinder rotary speed and the speed at which the band of fibers is fed to the separating cylinder.

6. A circular knitting machine for the production of knit goods having combed-in fibers with a preselected fiber density, comprising: a needle cylinder having needles and being rotatable at variable rotary speeds; a carding unit having feeding means for feeding a band of fibers, a combing-in zone through which the needles pass for the purpose of contactless fiber pickup, and a separating cylinder being rotatable at high speed independently from the rotary speed of the needle cylinder for receiving the band, separating said band into single fibers and delivering the fibers into the combing-in zone; a drive means for the synchronous driving of the needle cylinder and feeding means; and a controller means becoming active upon abrupt changes in the rotary speed of the needle cylinder for the asynchronous changing of the amount of fibers yielded to the combing-in zone, said controller means having a differential drive means with an output connected to the feeding means and two inputs, one of which is connected to the drive means and the other to a servo motor for changing the ratio between the needle cylinder speed and the rate of speed at which the fibers are fed to the separating cylinder.

7. A circular knitting machine according to claim 6, wherein the servo motor is a motor that can be switched to opposite directions of rotation.

8. A circular knitting machine according to claim 6, wherein the controller means has a stop switch upon whose operation an actuating signal for the servo motor is produced.

9. A circular knitting machine according to claim 6, wherein the controller means has a start switch upon operation an actuating signal for the servo motor is produced.

10. A circular knitting machine according to claim 8 or 9, wherein the controller means has an indicator element associated with the drive means and having an output at which an output signal proportional to the momentary rotary speed of the needle cylinder appears, and wherein between the switch and the servo motor a release circuit is connected such that the servo motor is actuated upon the attainment of preselected speeds of the needle cylinder.

* * * * *